United States Patent [19]

Preston et al.

[11] 4,426,015

[45] Jan. 17, 1984

[54] CONTAINER

[75] Inventors: Frederick R. Preston, Wolverhampton; Ronald L. Grosvenor, Codsall near Wolverhampton; Cecil Derry, Chase Terrace near Walsall, all of England

[73] Assignee: IMI Marston Limited, Wolverhampton, England

[21] Appl. No.: 263,735

[22] Filed: May 14, 1981

[30] Foreign Application Priority Data

May 19, 1980 [GB] United Kingdom ..... 8016408
Jan. 31, 1981 [GB] United Kingdom ..... 8103019

[51] Int. Cl.[3] ..... B65D 9/04; B65D 6/26

[52] U.S. Cl. ..... 220/403; 206/386; 217/43 A; 220/71; 220/462; 229/37 E

[58] Field of Search ..... 206/386, 600, 524, 523, 206/320, 601, 319, 326; 229/23 C, 37 E, 17 B, 7 R, 43 R; 220/403, 462, 463, 461, 441, 71, 404; 217/43 A, 12 R

[56] References Cited

U.S. PATENT DOCUMENTS

| | | | |
|---|---|---|---|
| 1,277,515 | 9/1918 | Wild | 217/12 R |
| 1,608,901 | 11/1926 | Miller | 220/404 |
| 2,006,705 | 5/1935 | Bangs | 220/403 |
| 2,481,855 | 9/1949 | McKenzie | 217/43 X |
| 2,483,481 | 10/1949 | Stetson | 217/43 X |
| 2,969,170 | 1/1961 | Waldorf | 229/23 C |
| 3,036,752 | 5/1962 | Elliott | 220/441 X |
| 3,073,500 | 1/1963 | Goodrich et al. . | |
| 3,128,904 | 4/1964 | Reilly | 220/462 X |
| 3,130,853 | 4/1964 | Colthurst et al. | 220/462 X |
| 3,137,433 | 6/1964 | Lipschutz et al. | 220/462 |
| 3,145,900 | 8/1964 | Franklin | 220/468 |
| 3,385,504 | 5/1968 | Adams | 220/441 X |
| 4,054,223 | 10/1977 | Marques | 220/403 X |
| 4,067,442 | 1/1978 | Howe | 220/441 X |
| 4,119,263 | 10/1978 | Cuthbertson et al. | 220/403 X |
| 4,141,466 | 2/1979 | Gordon et al. | 220/462 |
| 4,151,947 | 5/1979 | Partain | 229/37 R X |
| 4,166,569 | 9/1979 | Begnaud et al. | 220/463 X |
| 4,230,061 | 10/1980 | Robert et al. | 220/901 X |
| 4,230,227 | 10/1980 | Kowall et al. | 206/600 |

FOREIGN PATENT DOCUMENTS

| | | |
|---|---|---|
| 2845306 | of 0000 | Fed. Rep. of Germany . |
| 2024 | of 0000 | United Kingdom . |
| 883762 | of 0000 | United Kingdom . |
| 1279232 | of 0000 | United Kingdom . |
| 1295831 | of 0000 | United Kingdom . |
| 1297915 | of 0000 | United Kingdom . |
| 1378507 | of 0000 | United Kingdom . |
| 1400414 | of 0000 | United Kingdom . |
| 1467884 | of 0000 | United Kingdom . |
| 2006163A | of 0000 | United Kingdom . |

*Primary Examiner*—Allan N. Shoap
*Assistant Examiner*—Robert Petrik
*Attorney, Agent, or Firm*—Cushman, Darby & Cushman

[57] ABSTRACT

A container for fluids intended for use on a standard pallet, the container being formed of an outer fibreboard skin with an inner fluid-tight flexible bag, a series of posts each located vertically in the middle of a face of the container between the fibreboard skin and the flexible bag with a series of tension struts interlocating the upper and lower ends of the posts to prevent the bag expanding the container. The container is suitable for handling liquids or dry powder type fluids and can accommodate weights of the order of one ton while being easily dismantleable for despatch or storage. The container can be stacked three or more high.

21 Claims, 11 Drawing Figures

FIG.4.
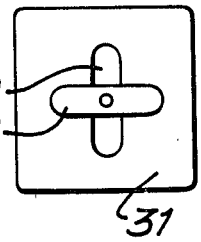
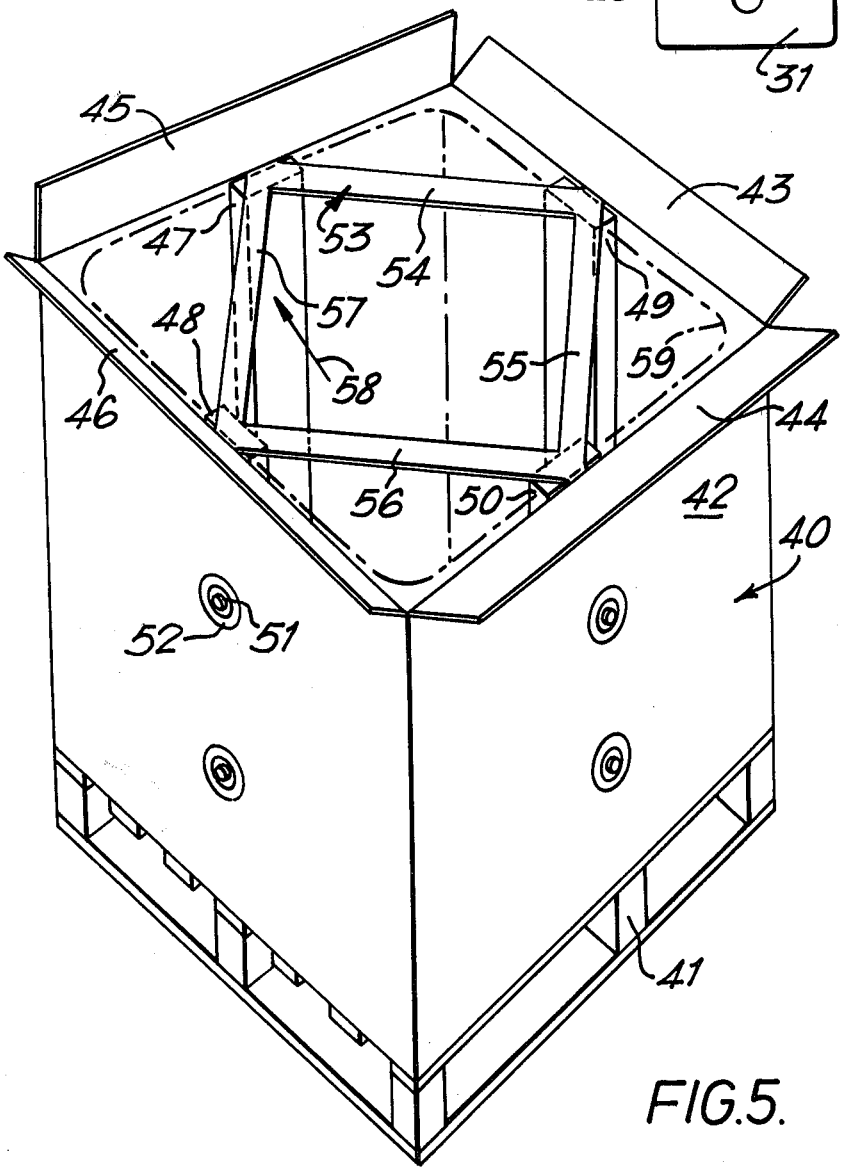
FIG.5.

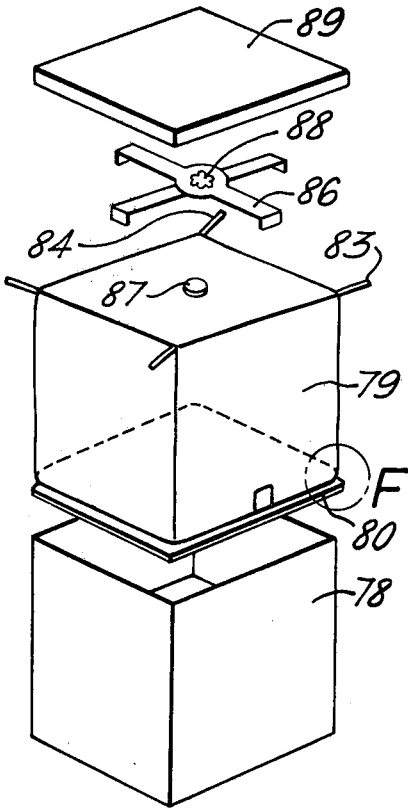
FIG.9.
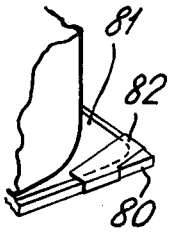
FIG.10.
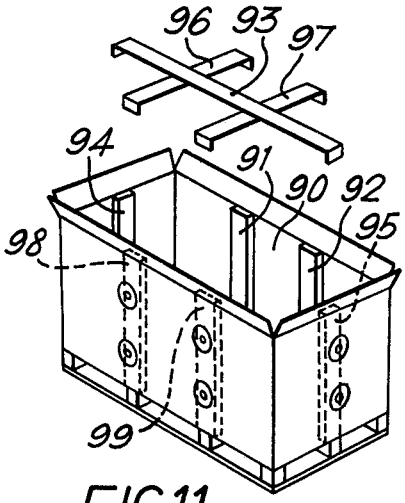
FIG.11.
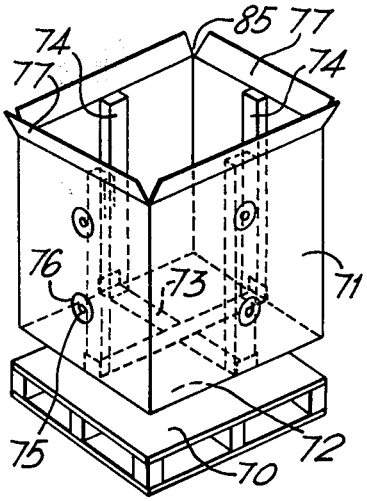

CONTAINER

BACKGROUND OF THE INVENTION

This invention relates to containers and has particular reference to containers for use on pallets. The conventional ways of shipping material, which is fluid by nature, either liquid or powder, normally comprise the use of small drums of 25 liters or 150 liters size or requires the use of bulk tankers capable of handling large volumes of liquid or other fluids. The bulk tankers are normally returned to base for refilling or reloading whereas the small containers are often regarded as disposable. Because of the cost of handling there is a requirement to increase the size of the small bulk containers without doing away with the advantages of the use of disposable containers. The present invention has particular application to containers capable of carrying loads of the order of one ton and being used on a standard sized pallet.

In British Patent Specification No. 1 400 414 there is described the use of a container of approximately the same size as that used for the present invention which comprises a double-skinned container with a wooden reinforcing strut located vertically in the centre of each face of the container between the skins. The skins are both structural members and the fluids are retained inside by means of a separate bag which is not shown specifically in the drawings of the patent specification. It has been found that there are differences in using containers of the type described in the above mentioned British patent for liquids as opposed to powders. By their very nature liquids are more mobile than dry powders and the container may be regarded as being more "active" during transport. The present applicants have found that although such a container is suitable for transporting dry powders it is necessary, when transporting liquids, to provide a restraining collar to support the container in use. Otherwise it has been found that the container can fail during transport. Experiments have illustrated that a restraining band of the order of $2\frac{1}{2}$ $cm^2$ of steel is sufficient to have strength to carry out the necessary restraining effect. It has also been found desirable to provide a $2\frac{1}{2}$ $cm^2$ rim around the pallet on which the container sits. Unfortunately the use of such restraining collars has two disadvantages. The first is the economic disadvantage in providing the collar, both in material costs, fabrication costs and handling costs. The second, perhaps more serious, is the loss of volume associated with the loss of the exterior $2\frac{1}{2}$ cm thick zone which is occupied by the collars and which could otherwise be useful for the transport of liquid. The loss of volume associated with the use of $2\frac{1}{2}$ $cm^2$ collars on a pallet 1 $m^2$ is 7 or 8%.

In British Patent Specification No. 1 467 884 there is described a modification of the invention described in British Patent Specification No. 1 400 414, in which the upright struts are secured to the outer skin by means of a turn buckle. Again, the invention described in British Patent Specification No. 1 467 884 requires the use of two structural skins which are separated by the upright struts.

To the best of the Applicant's belief there are no known containers for liquids capable of being used on a standard ISO pallet (1 $m^2$) which are formed basically of a fibre or cardboard exterior having a simple plastics liner. There are many proposals for using cardboard boxes to contain materials, and proposals have been made, see UK Patent Specification No. 2 024/1913, to use wires to strengthen cardboard boxes such as hat boxes or drawers. However, such systems would not be useful for semi-bulk containers of a size intended to be used on an industrial pallet.

In UK Patent Specification No. 883 762 there is described a reinforced fibreboard container being formed of inner and outer fibreboard layers, but there are no provisions to permit the box to withstand the pressures found in semi-bulk containers for liquids.

UK Patent Specification No. 1 279 232 is concerned with composite boxes having a capacity in the region 100–200 gallons, but proposes the use of expensively machined corner portions to withstand the pressures attendant upon the use of fibreboard for the external shell of the container.

In UK Patent Specification No. 1 295 831 a stillage bin is provided in which internal pressures are resisted by an external framework provided around the container.

UK Patent Specification No. 1 297 915 proposes a container in which wooden posts are used in the corners to support the corners of the container.

UK Patent Specification No. 1 378 507 proposes a container in which rigid reinforcing elements are secured to the faces of the panels in a horizontal plane.

SUMMARY OF THE INVENTION

By the present invention there is provided a container for fluids comprising a fluid-tight inner bag, an outer skin of polygonal shape and a top and base formed of flap extensions of the walls of the skin, a plurality of support struts, each located in an upright position on the inside face of one side wall, each wall being provided with at least one rigid support strut, and the rigid support struts being secured to their respective side walls, upper tension means to interconnect the upper ends of the support struts so as substantially to prevent the ends moving apart and lower tension means to interconnect the lower ends of the support struts so as substantially to prevent the ends moving apart.

Preferably, the upper and lower tension means are located between the ends of the inner bag and the flap extensions of the walls.

Preferably there are four walls with four rigid support struts. Preferably there is one rigid support member per wall. There may be two or more rigid supports per wall. Each strut may be located centrally in a wall when the number of struts is the same as the number of walls.

Each tension means may include a pair of support struts interconnecting opposing faces. Alternatively there may be provided a rectangular tension means so as to interconnect adjacent posts.

The outer skin is preferably formed of cardboard or other fibre board and is preferably formed of corrugated cardboard. Particularly suitable material is Triwall corrugated cardboard which comprises three corrugated layers superimposed one directly on the other.

The upper and lower tension means may be steel straps in engagement with the support struts. The steel straps preferably have integral tags to engage the support struts between the support struts and the walls of the container. The support struts may be formed of wood. They may be connected to the walls of the box by bolts which may be passed through holes in the walls of the box and provided with reinforcing plates externally of the fibreboard walls. Each support member may have two bolts located uniformly along its length intermediate the ends thereof.

The base of the fluid-tight bag may be secured to a sheet of material prior to insertion into the container. The material may be cardboard. The upper corners of the fluid-tight bag may be secured to corners of the container after insertion into the container.

The lower flaps may be so arranged as to fold to form a completely covered lower end for the container. The upper end flaps may be of a length such that, when folded over to form a top to the container, they permit access to the fluid-tight bag. The upper end flaps are preferably folded over to form the upper end and secured in position prior to filling the fluid-tight bag. The upper end flaps may be secured in position with self-adhesive tape. There may be provided an abrasion-resistant liner between the support struts and the fluid-tight bag. The abrasion-resistant liner may be in the form of a tube having substantially the same external cross-section as the internal cross-section of the container.

The upper tension means may be joined together where they cross, there may be provided an aperture through the conjoined region of the upper tension means. In the alternative the upper tension means may be flexible and may be formed of a webbing.

The container preferably has a plan area substantially identical to that of a standard pallet. The fluid-tight bag may be formed of an unreinforced plastics material or alternatively may be formed from a fabric reinforced plastics material. The bag may be provided with an entry filler point and an exit emptying point. Preferably the emptying point is located at the bottom of the bag and the filler point is located at the top of the bag.

The present invention also provides a kit of parts for a container comprising the features set out above. The present invention also envisages the assembly of a kit of parts and the filling of the so-assembled container, including the steps of folding in the lower flaps to form the base of the container, locating the lower tension means in the base of the container, inserting the support struts into the container, positioning the support struts over the lower tension means and securing the support struts to the walls, locating the abrasion-resistant liner in the container, attaching the base of the fluid-tight bag to a sheet of material, inserting the sheet of material into the base of the container, securing the upper corners of the fluid-tight bag to the corners of the container, locating the upper tension means over the bag on the upper ends of the support struts, closing the upper end flaps to form the upper end of the container and subsequently filling the fluid-tight bag with a fluid.

The container may be positioned on a pallet prior to filling. A lid may be located on the container after filling. The lidded container may be strapped to the pallet.

BRIEF DESCRIPTION OF THE DRAWINGS

By way of example embodiments of the present invention will now be described with reference to the accompanying drawings, of which;

FIG. 4 is an elevational view of a toggle and reinforcing plate.

FIG. 5 is a perspective view of an alternative form of container;

FIG. 9 is an exploded view of a container in accordance with the present invention;

FIG. 10 is an enlarged view of a corner of a portion of the container of FIG. 8 illustrated in the circle; and FIG. 11 is a perspective view of an alternative form of container construction.

DESCRIPTION OF THE PREFERRED EMBODIMENTS

Figure 1:
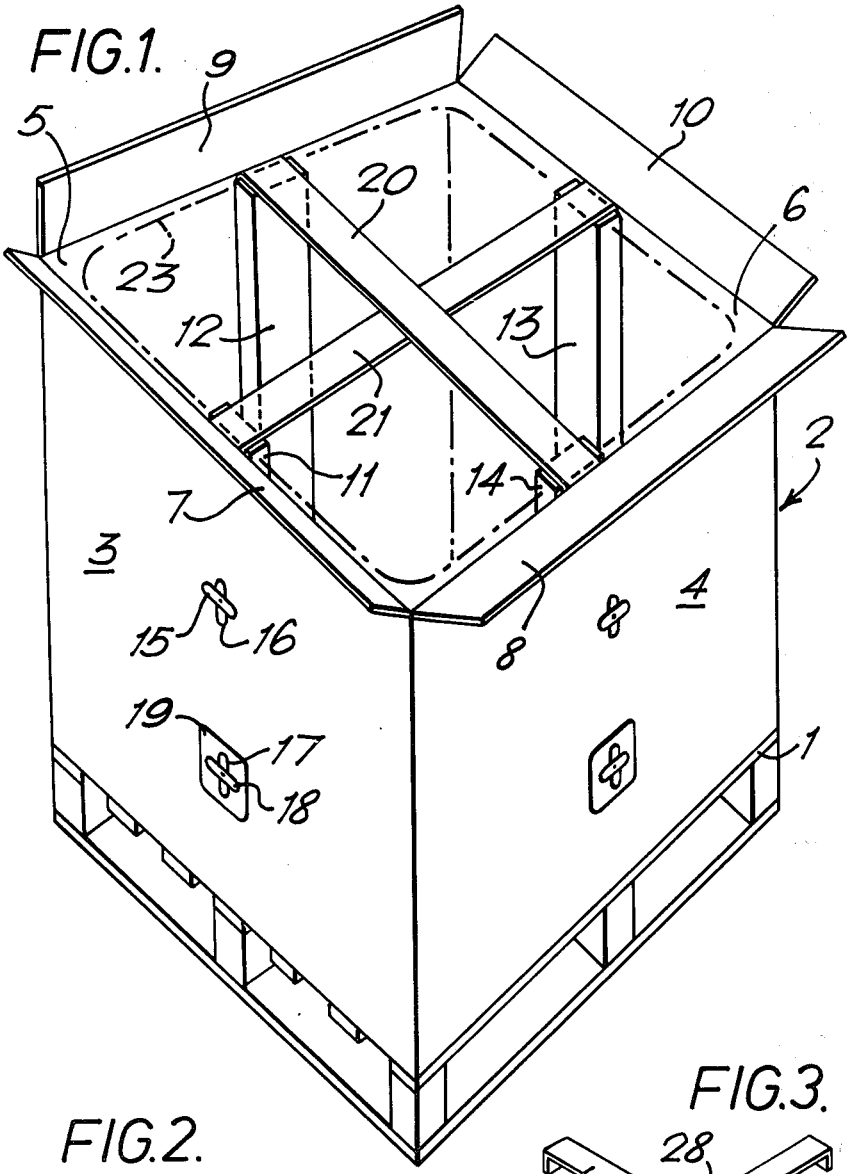
FIG. 1 is a perspective view of a container in accordance with the present invention.

Referring to FIG. 1 this shows a standard ISO pallet 1 on which is located a container indicated generally by 2. The container has four walls 3, 4, 5 and 6 which are formed from Triwall triple wall thickness corrugated cardboard. The top of each wall is formed into an integral flap such as 7, 8, 9 and 10 which can be folded over to form the top. It will be appreciated that the flaps need not extend completely over the top of the container. Similar flaps or extensions are formed on the bottom of each of the walls to be folded in to form the bottom of the container.

Located within the container are four wooden support struts or posts such as 11, 12, 13, and 14. Each of the posts is formed of wood and has a size approximately 5 cm×8 cm. The wooden posts extend for the entire height of the container and are located in place on the external walls of the container by means of turn buckles such as turn buckle or toggle 15. The toggle or turn buckle 15 is rotatably mounted on the post and can be pushed through an elongate slot 16 in the wall 3 and rotated to locate the toggle firmly in position and hence locate the upright post 11 firmly in position. For standard pallets of 1 m plan area it has been found preferable to use two toggles and further it has been found preferable to use a reinforcing plate 17 to spread the load of the lower toggle 18 over a greater area. The spreader or reinforcing plate 17 may be formed with integral corners such as 19 which dig into the corrugated cardboard to locate it firmly in position. If desired the spreader or reinforcing plate 17 may be provided with corrugations to increase its resistance to bending.

Figure 2:
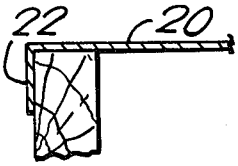
FIG. 2 is a side part sectional view of the connection between a support member and a tension member.

As can be clearly seen, in the upper regions of the container there is provided a pair of tension members 20 and 21. The tension members are in the form of steel straps which are located to interconnect opposing support struts 12 and 14 and 11 and 13 respectively. The tension members have integrally formed tabs such as 22 (FIG. 2) which frequently engage the support struts.

Located within the cardboard container is a fabric reinforced flexible bag illustrated dotted at 23. It has been found that with a standard 1.12 $m^2$ pallet a container having a volume of about 1 $m^3$ can be provided directly on the pallet without the need for any external reinforcing collar to be provided. This means that the full plan area of the pallet can be used and the container can have a maximum internal volume for the transport of fluids.

The pallets may be stacked one on top of the other and the support struts 11, 12, 13 and 14 provide strength to the container such that stacking can comfortably occur.

Figure 3:
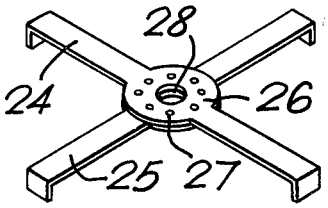
FIG. 3 is a perspective view of alternative tension members.

Referring to FIG. 3 this shows an alternative form of tension means in the form of a pair of metal straps 24, 25 which are formed with an enlarged central region 26. The enlarged central regions are spot welded together as at 27 and are provided with an aperture 28 through which the entry valve for the container 23 can be passed.

Referring to FIG. 4 this shows in more detail the toggle and reinforcing plate. The toggle 29 is inserted through an aperture 30 in the plate and wall and rotated to engage with the reinforcing plate 31 and hold the plate firmly against the wall of the container.

Referring to FIG. 5 this shows an alternative form of tension means in a container generally illustrated as 40. The container is supported on a standard ISO pallet 41 and is formed of a cubic fibreboard body 42 having extension flaps 43, 44, 45 and 46 forming the upper end of the container. The lower end has similar extension flaps not shown. As before there are four support posts 47 to 50 which in this embodiment are bolted to the walls of the container. Bolts such as 51 are used and the load imposed by the bolts is supported by spreader plates 52. As before two bolts and spreader plates per post are used as is clearly illustrated in the drawings. In the embodiment illustrated in FIG. 5 the loads imposed on the posts tending to spread them apart are restrained by a square tension member indicated generally as 53. The tension member is in the form of an open square or window frame having four legs 54, 55, 56 and 57. The member 53 is secured to each of the posts 47 to 50 as is illustrated in more detail in FIG. 7 and as will be explained below.

The loads imposed on the posts such as post 47 are generally in the direction of the arrow 58. The picture frame 53 restrains the outward movement of the posts 47 to 50 by each leg being in tension in a similar manner to the method illustrated in connection with the embodiment shown in FIG. 1. It can be seen by resolving the forces acting in the legs of the picture frame 54 to 57 that the forces 58 can be resolved into pure tensile components in the legs 54 to 57. As before a fluid-tight bag 59 is located inside the container to hold the liquid.

Figure 6:
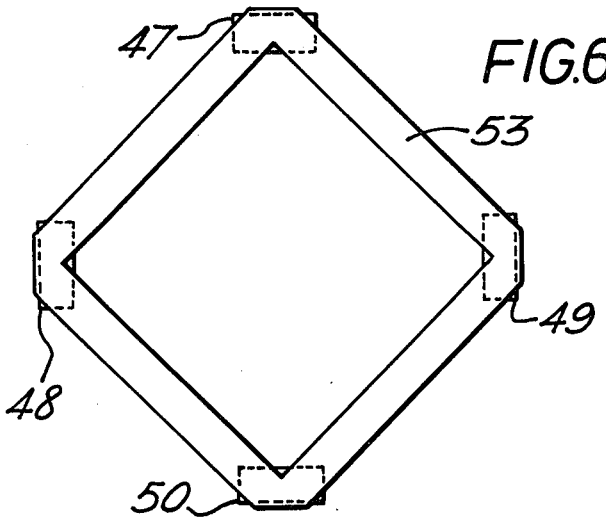
FIG. 6 is a plan view of the tension means of FIG. 5.
Figure 7:
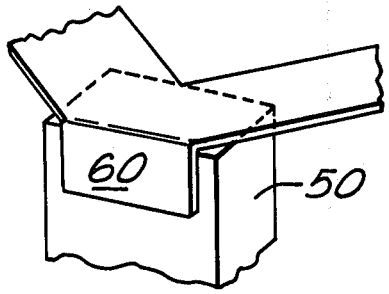
FIG. 7 is an enlarged view of the connection between the post and the tension means of FIG. 6.

Referring to FIG. 6 there is shown in plan view the picture frame member 53 which is secured to each of the upright posts 47 to 50. The most convenient method of securing the picture frame to the posts is illustrated in FIG. 7. It can be seen that the corners of the picture frame are bent over as at 60 and slip over the back of the post such as post 50. If required the bent-over flaps could be nailed to the post 50.

Figure 8:
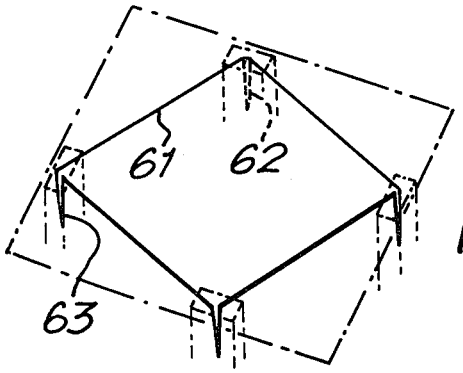
FIG. 8 is a perspective schematic view of an alternative form of upper tension means.

In an alternative form of tension means illustrated in FIG. 8 the tension means comprises a wire loop 61 formed at each corner with a downwardly directed peg 62. The ends of the loop may be formed to go into a single peg as at 63. The wire loop is held in the posts by driving the pegs 62 into the posts in the manner of nails.

For ease of understanding there is illustrated in FIG. 9 an exploded perspective view of a container in accordance with the present invention. The container is located on a wooden pallet 70 of conventional design. Located immediately on top of the wooden pallet is a fibreboard box 71 which has lower end flaps folded over from each of the sides to form a lower end wall 72. The width of the flaps is a half of the width of the wall so that the end flaps meet to form a double layer base. Located within the container 71 is a lower cruciform 73 which engages the lower ends of four wooden posts 74. The wooden posts are each secured to their respective side faces by means of bolts 75 which are secured to the side walls with load spreading plates 76. The upper ends of each of the walls are provided with flaps 77 which are folded later during the construction and filling of the container.

A loose cardboard sheet liner 78 is then inserted into the container. The height of the sheet 78 is approximately the same as the height of the container 71. This protects the flexible bag from chafing against the post 74.

After the liner 78 has been inserted the flexible bag 79, which has been taped to a cardboard base 80, is located in the container. The cardboard base 80 serves to hold the bottom of the flexible bag 79 accurately in position within the container and eases filling of the container with liquid. When using very thin flexible bags it has been discovered that in the absence of locating the bottom of the bag accurately in the container 71 the bottom can become creased and the creases are held in position by the weight of liquid filling the bag. As is illustrated in detail in FIG. 10 it can be seen that the corners of the base 81 of the bag 80 are taped to the cardboard sheet 81 by means of conventional flexible transparent tape such as 82.

The upper corners of the bag 79 are each provided with extensions 83, 84. These extensions may be in the form of loops or simple strips. The extensions are laid out through the corners of the container in the space between the edges of the flaps 77. Thus the extension 84 would be taken through the gap 85 and held in position on the fibreboard container by means of a suitable adhesive tape.

The upper cruciform 86 would then be located over the flexible container and secured to the upper ends of the wooden posts 74. The filler aperture 87 is then located in the aperture 88 in the cruciform 86. The flaps 77 are then turned over on top of the container and taped in position. The container may then be filled with liquid and after filling the filler aperture 87 can be released from the cruciform 86 to reduce excess tension loads on the material of the bag 79. The cardboard cap 89 is then placed on top of the container and the entire filled container can then be banded to the pallet 70 by use of steel bands in the conventional manner.

It will be appreciated that although there is described above containers utilising only one vertical post per side, if the length of the container became greater than that for which one post was suitable two or more posts per side could be used. Such an arrangement is illustrated in FIG. 11 and it can be seen that the side wall 90 of the container is provided with a pair of posts 91, 92. The upper and lower cruciforms are each provided with a single spine 93 to interconnect end posts 94 and 95 with a pair of cross members 96, 97 to interconnect posts 91 and 98 and 92 and 99 respectively.

Clearly, each of the end walls could be provided with two posts and it may be desired to provide three or more posts on one or more sides.

It will be appreciated that lower tension means are provided at the lower end of each of the posts in the container. Clearly the lower tension means could be of the same type as the upper tension means or alternatively different types could be used at the top and bottom of the container.

We claim:

1. An intermediate bulk container for liquids comprising a liquid-tight inner bag, an outer skin of polygonal shape and a top and base formed of flap extensions of the walls of the skin, a plurality of support struts, each located in an upright position away from the corner on the inside face of one side wall, each wall being provided with at least one rigid support strut, and the rigid support struts being secured to their respective side walls, in which there is provided upper tension means to interconnect the upper ends of the support struts so as substantially to prevent the upper ends moving apart and lower tension means to interconnect the lower ends of the support struts so as substantially to prevent the lower ends moving apart, the upper and lower tension means being located between the ends of the inner bag and the flap extensions of the walls and including integral tags to engage the support struts between the support struts and the wall of the container, the upper end flaps being of such a length that, when folded over to form a top to the container, they permit access to the liquid-tight inner bag.

2. A container as claimed in claim 1 in which the upper end flaps are folded over to form the upper end and secured in position prior to filling the liquid-tight bag.

3. A container as claimed in claim 2 in which the upper end flaps are secured with self-adhesive tape.

4. A container as claimed in claim 1 in which the base of the liquid-tight bag is secured to a sheet of material prior to insertion into the container.

5. A container as claimed in claim 1 in which the base of the liquid-tight bag is secured to the base of the container prior to filling.

6. A container as claimed in claim 4 in which the upper corners of the liquid-tight bag are secured to the corners of the container after insertion into the container.

7. A container as claimed in claim 6 in which the upper corners of the liquid-tight bag are provided with integral extensions which are secured to the corners of the container.

8. A container as claimed in claim 7 in which the integral extensions are secured to the outside of the corners of the container by self-adhesive tape.

9. A container as claimed in claim 1 in which there are four walls with four support struts, one per wall, each located centrally in a wall, the support struts being connected to the walls of the box by bolts passing through holes in the walls of the box and provided with reinforcing and load spreading plates externally of the walls.

10. A container as claimed in claim 1 in which the outer skin is formed of cardboard or other fibreboard.

11. A container as claimed in claim 10 in which the outer skin is formed of corrugated cardboard.

12. A container as claimed in claim 11 in which the corrugated cardboard skin has at least three corrugated layers superimposed one directly on the other and separated by planar cardboard layers, there being an external planar layer on each face of the assembly.

13. A container as claimed in claim 1 in which one at least of the tension means comprises a rectangle to interconnect adjacent posts.

14. A container as claimed in claim 1 in which an anti-abrasive layer of cardboard or stiff paper is provided between the flexible liquid-tight inner bag and the support struts.

15. A container as claimed in claim 1 in which the lower flaps fold to form a completely covered lower end to the container.

16. A container as claimed in claim 1 in which the liquid-tight bag is formed of flexible plastics material.

17. A container as claimed in claim 1 in which it has a plan area substantially identical to that of a standard pallet.

18. A container as claimed in claim 1 in which there is provided a lid for the filled container.

19. A kit of parts for a container as claimed in claim 1 including, in a disassembled condition, an outer skin, an inner liquid-tight bag, support struts and upper and lower tension means.

20. A kit of parts as claimed in claim 19 also including an abrasion-resistant inner liner and a lid.

21. An intermediate bulk container for liquids comprising a liquid-tight inner bag inserted into an outer skin of polygonal shape, said skin having a top and base formed of flap extensions of the walls of the skin, a plurality of support struts, each located in an upright position away from the corner on the inside face of one side wall, each wall being provided with at least one rigid support strut, and the rigid support struts being secured to their respective side walls, in which there is provided upper tension means to interconnect the upper ends of the support struts so as substantially to prevent the ends moving apart and lower tension means to interconnect the lower ends of the support struts so as substantially to prevent the ends moving apart, the upper end flaps being of such a length that, when folded over to form a top to the container, they permit access to the liquid-tight inner bag, the inner bag having a base secured to a sheet of material prior to insertion into the skin and the upper corners of the inner bag being secured to the corners of the skin after insertion into the skin.

* * * * *